US005857223A

United States Patent [19]

Ferdinand

[11] Patent Number: 5,857,223

[45] Date of Patent: Jan. 12, 1999

[54] BATHROOM FLIPPER

[75] Inventor: Donald A. Ferdinand, 168-06 Linden Blvd., St. Albans, N.Y. 11434

[73] Assignee: Donald A. Ferdinand, St. Albans, Qns., N.Y.

[21] Appl. No.: 993,720

[22] Filed: Dec. 18, 1997

[51] Int. Cl.[6] ..... A47K 13/10

[52] U.S. Cl. ..... 4/246.1

[58] Field of Search ..... 4/246.1–246.5

[56] References Cited

U.S. PATENT DOCUMENTS

| | | | |
|---|---|---|---|
| 1,119,574 | 12/1914 | Coppedge | 4/246.5 X |
| 1,180,140 | 4/1916 | Godoy | 4/246.3 X |
| 2,954,565 | 10/1960 | Miller | 4/246.3 |
| 4,807,307 | 2/1989 | Sato | 4/251 |
| 5,056,165 | 10/1991 | Wescott | 4/249 |
| 5,488,743 | 2/1996 | Alfonso | 4/246 |

*Primary Examiner*—Charles E. Phillips

[57] ABSTRACT

A bathroom flipper comprising: a support frame; which has a left arm and a right arm, each arm comprising front and back legs which extend downwardly towards a floor surface, the arms each further have a hinge housing extending upward from a top surface of the arms at a front portion thereof, a pedal bar is hingedly attached to the support frame at inwardly facing walls of each hinge housing, the pedal bar generally parallel to the support frame, the pedal bar comprises a left arm, a right arm, and a front panel, each pedal bar arm comprises a plurality of adjustment apertures along the horizontal axis thereof, the front panel comprises a lifting pedal which extends outwardly from the pedal bar toward a user, the pedal bar left arm has a return pedal extending inwardly; a lid lifting assembly is hingedly attached to the pedal bar left arm at a back distal edge thereof, and comprises a support shaft extending upwardly from the pedal bar, and a lifting rod extending inwardly, the support shaft has apertures along the vertical axis thereof to allow for height adjustment, the lifting rod is removably connected to a bottom surface of a toilet seat, the device functioning to allow a user to depress the lifting pedal downwardly, raising a back distal edge of the pedal bar, raising the support shaft, raising the lifting rod, which in turn raises the toilet seat, the device further functioning to allow a user to depress the return pedal, lowering the support shaft, lowering the lifting rod, which in turn lowers the toilet seat.

3 Claims, 2 Drawing Sheets

BATHROOM FLIPPER

BACKGROUND OF THE INVENTION

1. Field of the Invention

The present invention relates to a toilet seat lifting device. More particularly, the present invention relates to a toilet seat lifting device, wherein the device allows the user to depress a foot pedal bar that lifts a crank arm assembly which removably attaches to the bottom surface of the toilet seat. Thus, the user can lift and lower the toilet seat quickly and effectively without touching the seat directly, providing great convenience and reduction of health risks.

2. Description of the Prior Art

Several innovations for toilet seat lifting devices have been provided in the prior art that are described as follows. Even though these innovations may be suitable for the specific individual purposes to which they address, they differ from the present invention as hereinafter contrasted.

1. U.S. Pat. No. 5,488,743, Toilet Seat Pedal Lifter, Inventor—Alfonso:

The patent by Alfonso discloses a mechanical apparatus used to lift and lower the lid and seat of a toilet by way of a pedal mechanism. The pedal mechanism is connected by levers to a cylindrical lifting device mounted on a shaft. The lifting device is connected to the lid and seat by clasps which are screwed, bolted riveted, or glued to the toilet lid and seat. The apparatus is held in place by floor braces attached by threaded studs which are fixed to the floor by nuts or by being cemented in depending on the material to be fixed to. An adjusting lever proceeding from the lifting device and connected to the pedal mechanism by a lever, can be adjusted so that the lid and seat stay up after taking the foot away from the pedal. One or both pedals can be actioned at the same time with one foot. The pedal stirrups are cup shaped. Thus the lid and seat can be lifted by pressing down with the sole of the shoe. To lower the seat and/or lid, the top of the shoe toe makes contact with the inside top of the pedal stirrup pressing upwards on the pedal thus lowering the seat and/or the lid. The entire apparatus can be made of synthetic materials and/or noncorrosive metal with the exception of the mounting shaft and the floor braces. For the mounting shaft and the floor braces noncorrosive metal is best due to the strain produced when fixing the apparatus in its place to keep it secured.

2. U.S. Pat. No. 5,056,165, Commode Flush and Seat Lift Apparatus, Inventor—Wescott:

The patent by Wescott teaches the use of an apparatus including a conduit arrangement directing linkage to individually and selectively lift a toilet scat in cooperation with a flush lever of a commode organization to minimize manual contact with the commode apparatus.

3. U.S. Pat. No. 4,807,307, Device For Opening and Closing the Seating Plate of the Lavatory Unit of the Seat Type, Inventor—Sato:

The patent by Sato describes a device for opening and closing the seating plate of the lavatory unit of the seat type wherein the unit is provided with only the seating plate. The device includes a spring for connecting a movable member attached to the unit body with the seating plate freely swingably pivoted on the unit body at one end rim thereof, an opening mechanism for moving the movable member to reverse the urging direction of the spring from its seating-plate-closing direction to its seating-plate-opening direction, and a closing mechanism for causing the seating plate to be closed. When the opening mechanism is made operative, the urging direction of the spring is reversed to open the seating plate. When the unit is provided with the seating and the cover plate. The device includes a pair of springs for connecting a pair of movable members attached to the unit body with the seating and the cover plate, which movable members are freely swingably pivoted on the unit body at one end thereof, a pair of opening mechanism for moving each of the movable members to reverse the urging direction of each spring from its seating- or cover-plate-closing direction to its seating- or cover-plate-opening direction, an interlocking mechanism for interlocking the cover-plate-opening with the seating-plate-opening mechanism, and a closing mechanism for causing the cover plate to be closed. The cover plate is thus similarly opened by the urging action of the spring and when the seating plate is opened, the cover-plate-opening mechanism is interlocked with this seating-plate-opening action to open the cover plate.

The present invention provides numerous advantages over and differing features from than those outlined in the prior art above. Most notably, the present invention is designed with the ability to perform as an independent tool, unlike the patented inventions above, which affix more permanently to the toilets. That is, the mechanical motion and actions of the present invention can function as a complete unit irrespective of being attached to the pre-existing toilet system or be more permanently affixed to the toilet, unlike any machine of its type.

In addition, upon review of the prior art, only the present invention teaches the usage of a horseshoe-shaped base combined with hinges as its principal support and movement structure. Similarly, only the present invention teaches the usage of a horseshoe-shaped pedal bar, equipped with a return pedal thereon. The design of the return strap differs significantly from that of the above-described inventions, and particularly that of Alfonso, as do the revolving plugs used by the present invention in its preferred mode.

Importantly, in the present invention only, the crank and lifting rod are combined and constructed as a single unit. Included in the many advantages of this construction are its convenience in installing and removing the bathroom flipper, and its overall lower production costs. Specifically, the bathroom flipper is very easy for the consumer to assemble, as the pedal bar attaches to hinges, and the crank or lifting arm attaches to the pedal bar, creating an effective unit which comprises only two principal rotating parts.

Finally, once again appearing in the present invention only, the toilet seat remains in an upright position until usage is complete. In the present invention, for further use the return foot pedal is simply pressed again. which allows the seat to fall to the closed position. This differs significantly from the other devices of its type described herein, where the user's foot remains on the pedal until usage is complete.

SUMMARY OF THE INVENTION

The present invention is a toilet seat lifting device, wherein the device is designed to ease the process of raising the toilet seat by hand. Instead, the bathroom flipper allows the user to depress a foot pedal bar that lifts a crank arm assembly which removably attaches to the bottom surface of the toilet seat. Thus, the user can lift and lower the toilet seat quickly and effectively without touching the seat directly, providing great convenience and reduction of health risks. Specifically, this unique mechanism reduces the risk of contracting and spreading germs from the bathroom, a highly frequented area of a high risk nature.

The bathroom flipper can be manufactured of lightweight materials, such as plastics, to both significantly reduce its manufacturing costs and facilitate the transport and installation of the device. Although such can be incorporated into the device if later desired the bathroom flipper does not at all require the usage of gears, chains, sprockets, bolts, screws, or metals in order to function effectively. In all cases, the preferred mode of manufacture utilizes the aforementioned plastic members and simple rotating plugs to connect the main parts.

With regards to manufacturing costs, the bathroom flipper can be used in private homes, as such will not be cost prohibitive for the consumer due to its usage of plastics. In addition, the device can be installed in public restrooms, such reststops, shopping malls, schools, restaurants, or hospitals, as such may be designated as higher health risk areas.

Regarding installation of the device, the bathroom flipper can be used in conjunction with any pre-existing toilet, as the crank or lifting assembly described herein will include the feature of multiple height adjustment apertures, enabling the user to adapt the length of the lifting arm to the height of the toilet in question. Moreover, the device of the present invention may be removably mounted to the toilet, as the lightweight support base may be affixed to the floor surface by a simple adhesive, or by hook and loop fasteners. Alternatively, should the commercial user of the bathroom flipper so desire, the device can be securely and permanently fastened to the floor surface, such as by bolts and similar fasteners.

In addition to the above, the present invention produced unexpected results, such as its compact size and shape of construction. Because the device comprises less rotating parts than those described in the prior art patents, the present invention is smaller and more compact. Because it utilizes the unique horseshoe-shaped support base and pedal bar, the present invention closely hugs around the pre-existing toilet and does protrude outwardly from the toilet into the main bathroom walking space. Therefore, the present invention is less visible than the prior art inventions, and creates no aesthetic or appearance problems to the residential or commercial user's bathroom.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF DESCRIPTION OF THE PREFERRED EMBODIMENT

DETAILED DESCRIPTION OF THE PREFERRED EMBODIMENT

Figure 1:
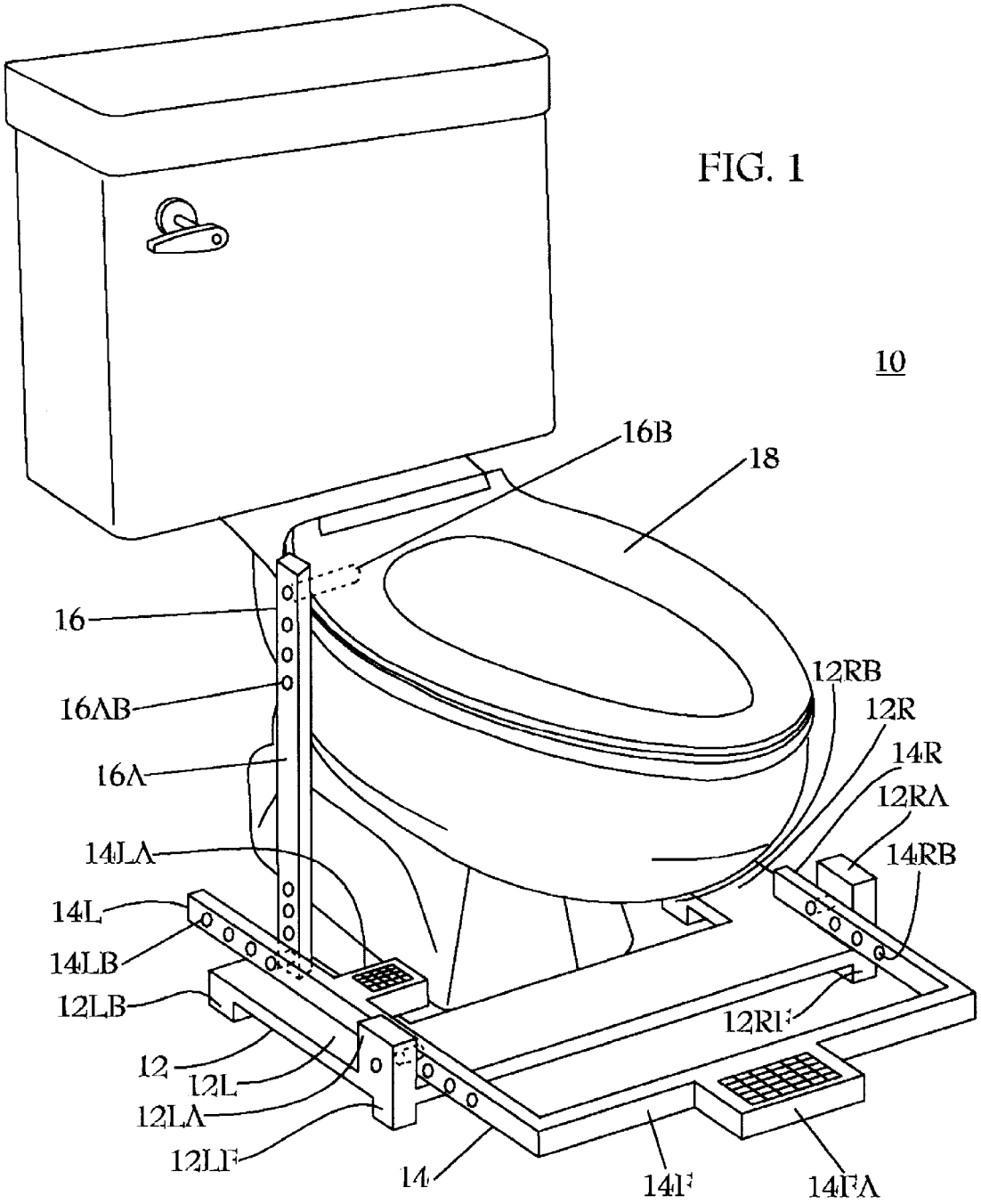
FIG. 1 is a three-quarters perspective view of the bathroom flipper from above.

Firstly, referring to FIG. 1, which is a three-quarters perspective view of the bathroom flipper from above: shown is a bathroom flipper device (10) comprising: a support frame (12): which comprises a support frame left arm (12L), and a support frame right arm (12R). The support frame left arm (12L) further comprises a left front leg (12LF) which extends downwardly towards a floor surface from a bottom surface of the support frame left arm (12L) at a front portion thereof, and a left back leg (12LB) which extends downwardly towards a floor surface from a bottom surface of the support frame left arm (12L) at a back portion thereof. The support frame right arm (12R) further comprises a right front leg (12RF) which extends downwardly towards a floor surface from a bottom surface of the support frame right arm (12R) at a front portion thereof, and a right back leg (12RB) which extends downwardly towards a floor surface from a bottom surface of the support frame right arm (12R) at a back portion thereof. The left arm (12L) further has a left hinge housing (12LA) extending vertically upward from a top surface of the left arm (12L) at a front portion thereof. Similarly, the right arm (12R) further has a right hinge housing (12RA) extending vertically upward from a top surface of the right arm (12R) at a front portion thereof.

A pedal bar (14) is hingedly attached to the support frame (12) at an inwardly facing wall of the left hinge housing (12LA) and an inwardly facing wall of the right hinge housing (12RA). In all instances described herein, the preferred mode of manufacture utilizes plastic support members and simple rotating plugs to hingedly connect the main parts. The pedal bar (14) is generally parallel to the support frame (12) along a horizontal axis. The pedal bar (14) comprises a pedal bar left arm (14L), a pedal bar right arm (14R), and a pedal bar front panel (14F). The pedal bar left arm (14L) comprises a plurality of left arm adjustment apertures (14LB) spaced equidistantly along the horizontal axis thereof. Similarly, the pedal bar right arm (14R) comprises a plurality of right arm adjustment apertures (14RB) spaced equidistantly along the horizontal axis thereof. The pedal bar front panel (14F) comprises a lifting pedal (14FA) which extends outwardly from the pedal bar (14) toward a user. The lifting pedal (14FA) is located in the center line of the pedal bar front panel (14F) so as to apply equal distribution of load on the left hinge housing (12LA) and right hinge housing (12RA). This lifting pedal (14FA), intended to be depressed downwardly by a user's foot, may further contain a non-skid substance on the top surface thereof.

The pedal bar left arm (14L) further comprises a return pedal (14LA) which extends inwardly toward the pedal bar right arm (14R). This return pedal (14LA), intended to be depressed downwardly by a user's foot, may further contain a non-skid substance on the top surface thereof. The pedal bar left arm (14L) further comprises a lid lifting assembly (16) hingedly attached to the pedal bar left arm (14L) at the back distal edge of the pedal bar left arm (14L) at a surface of the pedal bar left arm (14L) facing inwardly. The lid lifting assembly (16) comprises a support shaft (16A) extending generally vertically upward from the pedal bar (14), and a lifting rod (16B) extending generally horizontally inward toward a right side of the pedal bar (14). The support shaft (16A) further comprises a plurality of support shaft apertures (16AB) spaced equidistantly along the vertical axis thereof, the support shaft apertures (16AB) functioning to allow for height adjustment of the device (10). The lifting rod (16B) is removably connected to a bottom surface of a toilet seat (18) at a distal edge of the lifting rod (16B) by a lifting rod securement means (18A). In its preferred mode, the lifting rod securement means (18A) is a return strap that is glued to the underside of a toilet seat, such as by contact cement.

The device (10) described herein functions to allow a user to depress the lifting pedal (14FA) downwardly toward the support frame (12), thus raising a back distal edge of the pedal bar (14) vertically upward. This causes raising of the support shaft (16A) vertically upward, which causes raising of the lifting rod (16B) vertically upward. This will raise the toilet seat (18) vertically upward, accomplishing the purpose sought by the user in a safe and effective manner.

Figure 2:
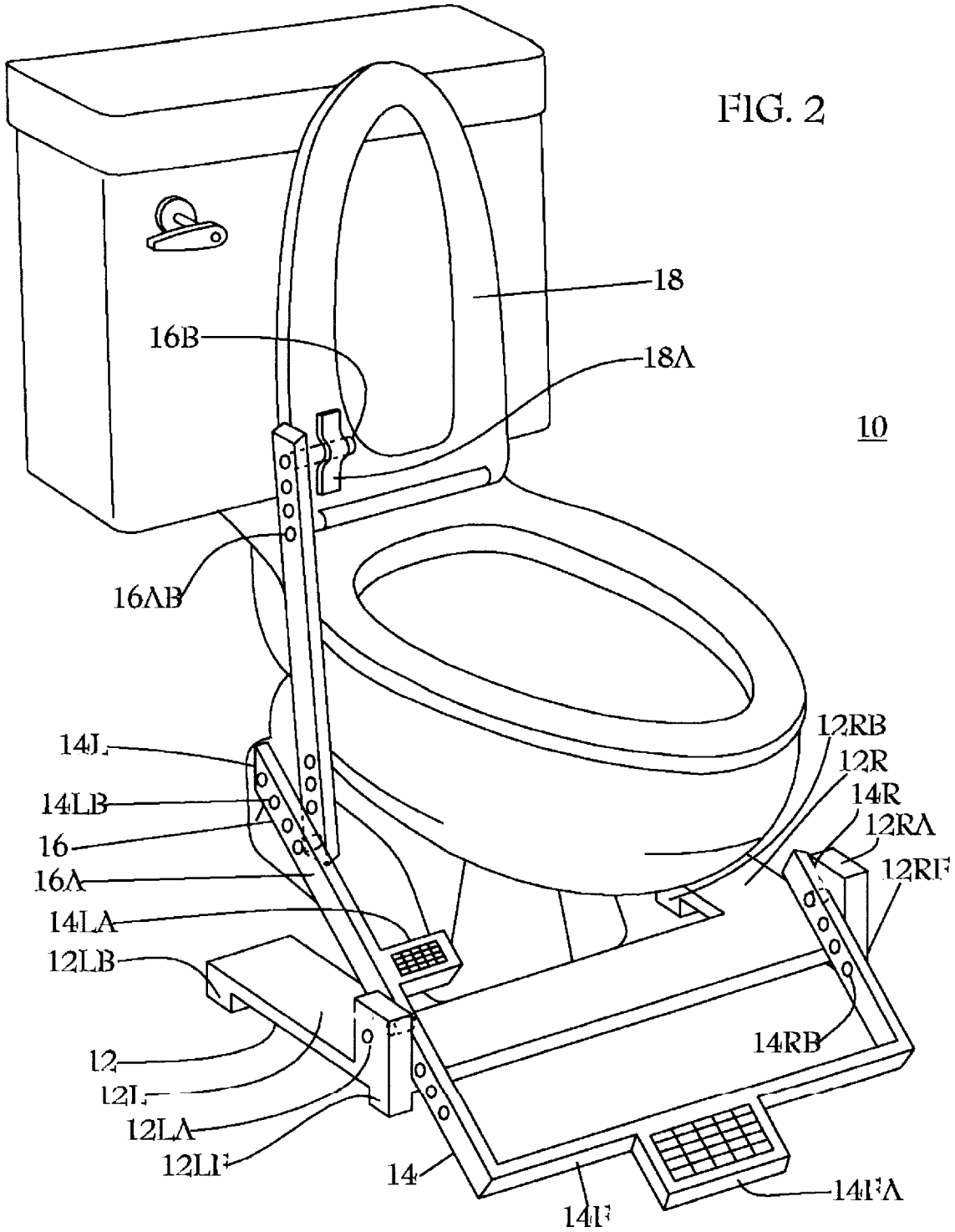
FIG. 2 is a three-quarters perspective view of the bathroom flipper from above, showing the device in the raised position.

Secondly, referring to FIG. 2, which is a three-quarters perspective view of the bathroom flipper from above, showing the device in the raised position: The device (10) further functions to allow a user to depress the return pedal (14LA) downwardly toward the support frame (12). This lowers the support shaft (16A) vertically downward, which in turn causes lowering of the lifting rod (16B) vertically downward. Finally, this lowers the toilet seat (18) downward accomplishing the secondary purpose sought by the user in a safe and effective manner.

The left hinge housing (12LA) may alternatively further comprise a plurality of apertures spaced equidistantly along the vertical axis thereof. Similarly, the right hinge housing (12RA) further comprises further comprises a plurality of apertures spaced equidistantly along the vertical axis thereof, the apertures functioning to allow for height adjustment of the device (10). The apertures will function to allow for height adjustment of the device (10) so that such device can be fitted to the height of any pre-existing toilet, allowing for wider spread usage of the device.

In addition, the lifting rod securement means (18A) may be selected from a group consisting of a pliable PVC plastic member, form-fitted hard plastic member, solid member, vinyl strap member, or cloth member that allows the lifting rod (16B) to rotate on a horizontal axis therein to lift the toilet seat (18) without friction. The lifting rod (16B) may alternatively extend generally horizontally inward toward a right side of the pedal bar (14) from a top distal edge of the support shaft (16A) is securely affixed to the support shaft (16A) by means of a ball joint (24). This will function to allow the lifting rod (16B) to extend inwardly therefrom at alternative angles to facilitate installation of the device (10) and lifting of the toilet seat (10). Once again, the preferred mode of manufacture of the entire device utilizes simple rotating plugs to hingedly connect the main parts.

It should be noted that the left front leg (12LF), the left back leg (12LB), the right front leg (12RF) and the right back leg (12RB) may be removably secured to a floor surface by means of an adhesive substance (20), which will be quite easy for the residential user to install, as well as cost-effective. Alternatively, the left front leg (12LF), the left back leg (12LB), the right front leg (12RF) and the right back leg (12RB) may be removably secured to a floor surface by means of hook and loop fasteners (22), equally easy to install and remove. Lastly, the device can easily be constructed to accommodate both standard bathroom floor tiles, as well as an office carpet.

Moreover, for the commercial purchasers of the bathroom flipper, the left front leg (12LF), the left back leg (12LB), the right front leg (12RF) and the right back leg (12RB) may be permanently secured to a floor surface, in an effort to ensure additional stability to a toilet of higher public usage, as well as to ensure that the device will not be stolen or moved. With regards to further stability and permanence, the device (10) may actually manufactured molded to a toilet (18) as a single-unit construction and sold as one-piece. Such would be suitable for the design and construction of new homes and office buildings, wherein the device can come with the unit and remain for years to come.

It will be understood that each of the elements described above, or two or more together, may also find a useful application in other types of constructions differing from the type described above.

While the invention has been illustrated and described as embodied in an bathroom flipper, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, constitute essential characteristics of the generic or specific aspects of this invention.

What is claimed as new and desired to be protected by Letters Patent is set forth in the appended claims.

What is claimed is:

1. A bathroom flipper device (10) comprising:

A) support frame (12); which comprises a support frame left arm (12L), and a support frame right arm (12R), the support frame left arm (12L) further comprises a left front leg (12LF) which extends downwardly towards a floor surface from a bottom surface of the support frame left arm (12L) at a front portion thereof, and a left back leg (12LB) which extends downwardly towards a floor surface from a bottom surface of the support frame left arm (12L) at a back portion thereof, the support frame right arm (12R) further comprises a right front leg (12RF) which extends downwardly towards a floor surface from a bottom surface of the support frame right arm (12R) at a front portion thereof, and a right back leg (12RB) which extends downwardly towards a floor surface from a bottom surface of the support frame right arm (12R) at a back portion thereof, the left arm (12L) further has a left hinge housing (12LA) extending vertically upward from a top surface of the left arm (12L) at a front portion thereof, the right arm (12R) further has a right hinge housing (12RA) extending vertically upward from a top surface of the right arm (12R) at a front portion thereof;

B) a pedal bar (14) hingedly attached to the support frame (12) at an inwardly facing wall of the left hinge housing (12LA) and an inwardly facing wall of the right hinge housing (12RA), the pedal bar (14) being generally parallel to the support frame (12) along a horizontal plane, the pedal bar (14) comprises a pedal bar left arm (14L), a pedal bar right arm (14R), and a pedal bar front panel (14F), the pedal bar left arm (14L) comprises a plurality of left arm adjustment apertures (14LB) spaced equidistantly along the horizontal axis thereof, the pedal bar right arm (14R) comprises a plurality of right arm adjustment apertures (14RB) spaced equidistantly along the horizontal axis thereof, the pedal bar front panel (14F) comprises a lifting pedal (14FA) which extends outwardly from the pedal bar front panel (14F) toward a user, the lifting pedal (14FA) located in the center line of the pedal bar front panel (14F) applying equal distribution of load on the left hinge housing (12LA) and right hinge housing (12RA), the pedal bar left arm (14L) further comprises a return pedal (14LA) which extends inwardly toward the pedal bar right arm (14R); and C) a lid lifting assembly (16) hingedly attached to the pedal bar left arm (14L) at the back distal edge of the pedal bar left arm (14L) at a surface of the pedal bar left arm (14L) facing inwardly, the lid lifting assembly (16) comprises a support shaft (16A) extending generally vertically upward from the pedal bar (14), and a lifting rod (16B) extending generally horizontally inward toward a right side of the pedal bar (14) from a top distal edge of the support shaft (16A), the support shaft (16A) further comprises a plurality of support shaft apertures (16AB) spaced equidistantly along the vertical axis thereof, the support shaft apertures (16AB) functioning to allow for height adjustment of the device (10), the lifting rod (16B) is removably connected to a bottom surface of a toilet seat (18) at a distal edge of the lifting rod (16B) by a lifting rod securement means (18A), the device (10) functioning to allow a user to depress the lifting pedal (14FA) downwardly toward the support frame (12), raising a back distal edge of the pedal bar (14) vertically upward, raising the support shaft (16A) vertically upward, raising the lifting rod (16B) vertically upward, which in turn raises the toilet seat (18) vertically upward, the device (10) further functioning to allow a user to depress the return pedal (14LA) downwardly toward the support frame (12), lowering the support shaft (16A) vertically downward, lowering the lifting rod (16B) vertically downward, which in turn lowers the toilet seat (18) vertically downward.

2. The bathroom flipper device (10) as described in claim 1, wherein the left front leg (12LF), the left back leg (12LB), the right front leg (12RF) and the right back leg (12RB) are permanently secured to a floor surface.

3. The bathroom flipper device (10) as described in claim 1, wherein the lifting rod securement means (18A) is selected from a group consisting of a pliable PVC plastic member, form-ritted hard plastic member, solid member, vinyl strap member, or cloth member that allows the lifting rod (16B) to rotate on a horizontal axis therein to lift the toilet seat (18) without friction.

* * * * *